US005878437A

United States Patent [19]

Pater

[11] Patent Number: 5,878,437

[45] Date of Patent: Mar. 9, 1999

[54] HOSPITAL GOWN

[76] Inventor: Carol K. Pater, 10164 S. Banner Hill Rd., Sandy, Utah 84092

[21] Appl. No.: 133,445

[22] Filed: Aug. 13, 1998

[51] Int. Cl.[6] ..... A41D 13/12

[52] U.S. Cl. ..... 2/69; 2/112; 2/114; 2/69

[58] Field of Search ..... 2/69, 83, 114, 2/70, 72, 88, 104, 217, 69.5, 74

[56] References Cited

U.S. PATENT DOCUMENTS

| | | | |
|---|---|---|---|
| 3,824,625 | 7/1974 | Green | 2/114 |
| 4,422,186 | 12/1983 | Loney | 2/114 |
| 4,845,779 | 7/1989 | Wheeler et al. | 2/69 |
| 4,920,578 | 5/1990 | Janzen et al. | 2/69 |
| 5,133,086 | 7/1992 | Truitt et al. | 2/69 |
| 5,414,867 | 5/1995 | Bowling et al. | 2/69 |

*Primary Examiner*—Michael A. Neas
*Assistant Examiner*—Kate Moran

[57] ABSTRACT

A hospital gown for permitting attachment of different portions of the hospital gown together to make it more convenient when performing various functions. The garment includes a hospital gown with an elongate main slit located on the back of the hospital gown and extending between the top neck opening and the bottom edge of the hospital gown. The outer side of the front of the hospital gown has spaced apart first, second and third attachment regions. The first attachment region is positioned adjacent the bottom edge of the hospital gown. The second attachment region is positioned between the top neck opening and the first attachment region and the third attachment region is positioned between the first and second attachment regions. The first attachment region is detachably attachable to the second and third attachment regions. The outer side of the back of the hospital gown has fourth and fifth attachment regions positioned on the outer side of the back of the hospital gown adjacent the bottom edge of the hospital gown. The fourth and fifth attachment regions each are detachably attachable to the second and third attachment regions.

11 Claims, 2 Drawing Sheets

HOSPITAL GOWN

BACKGROUND OF THE INVENTION

1. Field of the Invention

The present invention relates to hospital gowns and more particularly pertains to a new hospital gown for permitting attachment of different portions of the hospital gown together to make it more convenient when performing various functions.

2. Description of the Prior Art

The use of hospital gowns is known in the prior art. More specifically, hospital gowns heretofore devised and utilized are known to consist basically of familiar, expected and obvious structural configurations, notwithstanding the myriad of designs encompassed by the crowded prior art which have been developed for the fulfillment of countless objectives and requirements.

Known prior art hospital gowns include U.S. Pat. No. 5,062,159; U.S. Pat. No. 5,133,086; U.S. Pat. No. 5,150,477; U.S. Pat. No. 3,078,467; U.S. Pat. No. 3,574,864; and U.S. Pat. No. 2,601,278.

While these devices fulfill their respective, particular objectives and requirements, the aforementioned patents do not disclose a new hospital gown. The inventive device includes a hospital gown with an elongate main slit located on the back of the hospital gown and extending between the top neck opening and the bottom edge of the hospital gown. The outer side of the front of the hospital gown has spaced apart first, second and third attachment regions. The first attachment region is positioned adjacent the bottom edge of the hospital gown. The second attachment region is positioned between the top neck opening and the first attachment region and the third attachment region is positioned between the first and second attachment regions. The first attachment region is detachably attachable to the second and third attachment regions. The outer side of the back of the hospital gown has fourth and fifth attachment regions positioned on the outer side of the back of the hospital gown adjacent the bottom edge of the hospital gown. The fourth and fifth attachment regions each are detachably attachable to the second and third attachment regions.

In these respects, the hospital gown according to the present invention substantially departs from the conventional concepts and designs of the prior art, and in so doing provides an apparatus primarily developed for the purpose of has fasteners positioned at various locations to permit attaching different portions of the hospital gown together to make it more convenient when performing various functions.

SUMMARY OF THE INVENTION

In view of the foregoing disadvantages inherent in the known types of hospital gowns now present in the prior art, the present invention provides a new hospital gown construction wherein the same can be utilized for permitting attachment of different portions of the hospital gown together to make it more convenient when performing various functions.

The general purpose of the present invention, which will be described subsequently in greater detail, is to provide a new hospital gown apparatus and method which has many of the advantages of the hospital gowns mentioned heretofore and many novel features that result in a new hospital gown which is not anticipated, rendered obvious, suggested, or even implied by any of the prior art hospital gowns, either alone or in any combination thereof.

To attain this, the present invention generally comprises a hospital gown with an elongate main slit located on the back of the hospital gown and extending between the top neck opening and the bottom edge of the hospital gown. The outer side of the front of the hospital gown has spaced apart first, second and third attachment regions. The first attachment region is positioned adjacent the bottom edge of the hospital gown. The second attachment region is positioned between the top neck opening and the first attachment region and the third attachment region is positioned between the first and second attachment regions. The first attachment region is detachably attachable to the second and third attachment regions. The outer side of the back of the hospital gown has fourth and fifth attachment regions positioned on the outer side of the back of the hospital gown adjacent the bottom edge of the hospital gown. The fourth and fifth attachment regions each are detachably attachable to the second and third attachment regions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hospital gown apparatus and method which has many of the advantages of the hospital gowns mentioned heretofore and many novel features that result in a new hospital gown which is not anticipated, rendered obvious, suggested, or even implied by any of the prior art hospital gowns, either alone or in any combination thereof.

It is another object of the present invention to provide a new hospital gown which may be easily and efficiently manufactured and marketed.

It is a further object of the present invention to provide a new hospital gown which is of a durable and reliable construction.

An even further object of the present invention is to provide a new hospital gown which is susceptible of a low cost of manufacture with regard to both materials and labor, and which accordingly is then susceptible of low prices of sale to the consuming public, thereby making such hospital gown economically available to the buying public.

Still yet another object of the present invention is to provide a new hospital gown which provides in the apparatuses and methods of the prior art some of the advantages thereof, while simultaneously overcoming some of the disadvantages normally associated therewith.

Still another object of the present invention is to provide a new hospital gown for permitting attachment of different portions of the hospital gown together to make it more convenient when performing various functions.

Yet another object of the present invention is to provide a new hospital gown which includes a hospital gown with an elongate main slit located on the back of the hospital gown and extending between the top neck opening and the bottom edge of the hospital gown. The outer side of the front of the hospital gown has spaced apart first, second and third attachment regions. The first attachment region is positioned adjacent the bottom edge of the hospital gown. The second attachment region is positioned between the top neck opening and the first attachment region and the third attachment region is positioned between the first and second attachment regions. The first attachment region is detachably attachable to the second and third attachment regions. The outer side of the back of the hospital gown has fourth and fifth attachment regions positioned on the outer side of the back of the hospital gown adjacent the bottom edge of the hospital gown. The fourth and fifth attachment regions each are detachably attachable to the second and third attachment regions.

Still yet another object of the present invention is to provide a new hospital gown that helps hold portions of the gown out of the way when the wearer is performing various tasks and functions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
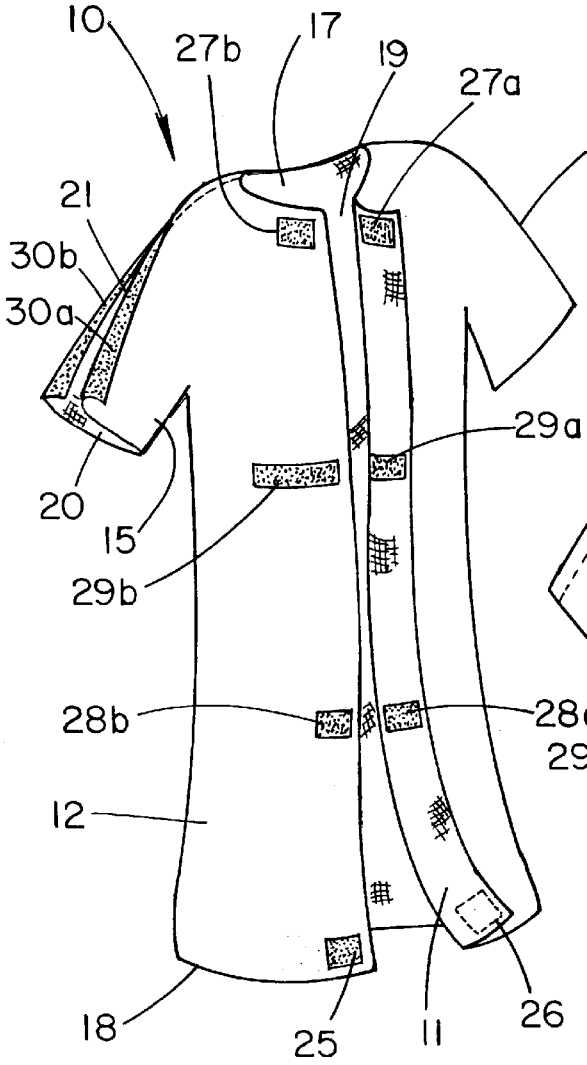
FIG. 1 is a schematic perspective view of the back of a new hospital gown according to the present invention.

With reference now to the drawings, and in particular to FIGS. 1 through 5 thereof, a new hospital gown embodying the principles and concepts of the present invention and generally designated by the reference numeral 10 will be described.

As best illustrated in FIGS. 1 through 5, a hospital gown 10 is provided with an elongate main slit 19 located on the back 14 of the hospital gown 10 and extending between the top neck opening 17 and the bottom edge 18 of the hospital gown 10. The outer side 12 of the front 13 of the hospital gown 10 has spaced apart first, second and third attachment regions 22,23,24. The first attachment region 22 is positioned adjacent the bottom edge 18 of the hospital gown 10. The second attachment region 23 is positioned between the top neck opening 17 and the first attachment region 22. The third attachment region 24 is positioned between the first and second attachment regions 22,23. The first attachment region 22 is detachably attachable to the second and third attachment regions 23,24. The outer side 12 of the back 14 of the hospital gown 10 has fourth and fifth attachment region 25,26 positioned on the outer side 12 of the back 14 of the hospital gown 10 adjacent the bottom edge 18 of the hospital gown 10. The fourth and fifth attachment region 25,26 each are detachably attachable to the second and third attachment regions 23,24.

In closer detail, the hospital gown 10 has inner and outer sides 11,12, a front 13, a back 14, a pair of sleeves 15,16 extending from the sides of the hospital gown 10. The hospital gown 10 also has a top neck opening 17, and a bottom edge 18. The hospital gown 10 has a width and a length defined between the top neck opening 17 and the bottom edge 18 of the hospital gown 10. The hospital gown 10 has an elongate main slit 19 therethrough between the inner and outer sides 11,12 of the hospital gown 10. The length of the main slit 19 extends between the top neck opening 17 and the bottom edge 18 of the hospital gown 10. The main slit 19 is located on the back 14 of the hospital gown 10. A pair of longitudinal edges are formed on the back 14 of the hospital gown 10 by the main slit 19.

Figure 4:
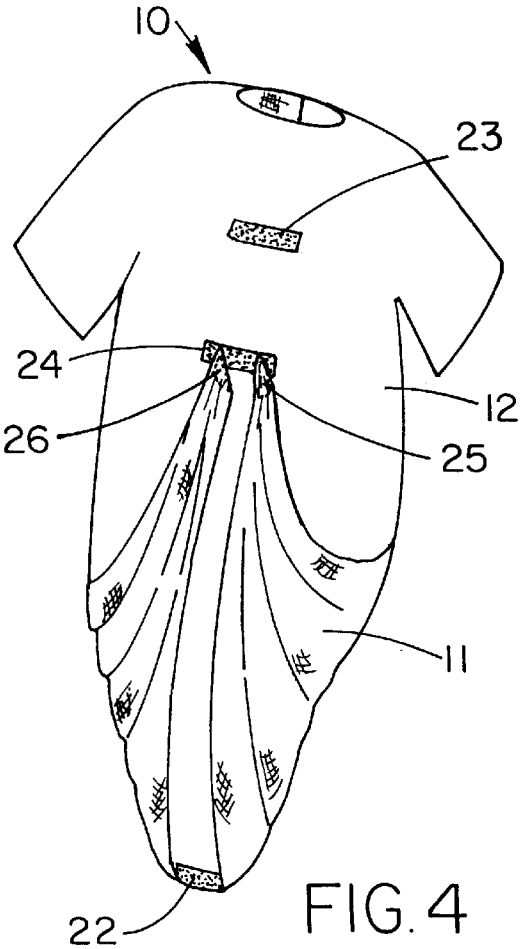
FIG. 4 is another schematic perspective view of the present invention with the fourth and fifth attachment regions attached to the third attachment region.
Figure 5:
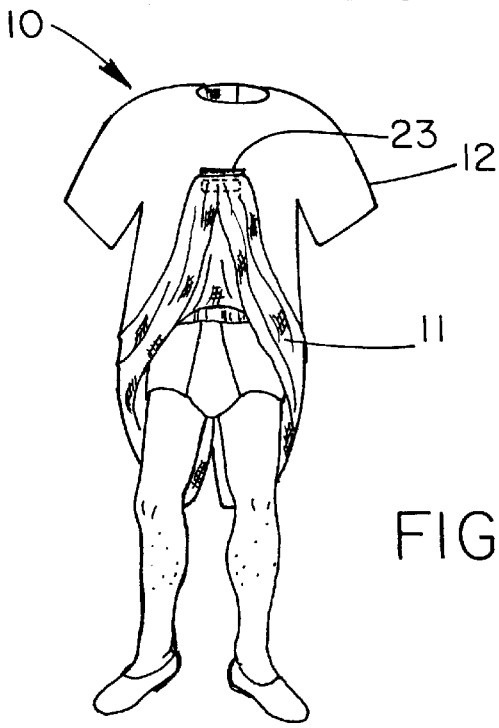
FIG. 5 is a schematic front side view of the present invention in use with the first attachment region attached to the second attachment region.

The outer side 12 of the front 13 of the hospital gown 10 has spaced apart first, second and third attachment regions 22,23,24. The first, second, and third attachment regions 22,23,24 are located on the outer side 12 of the front 13 of the hospital gown 10 preferably along a line extending between top neck opening 17 and the bottom edge 18 at a mid point of the width of the hospital gown 10. The first attachment region 22 is positioned adjacent the bottom edge 18 of the hospital gown 10. The second attachment region 23 is positioned between the top neck opening 17 and the first attachment region 22. Ideally, the second attachment region 23 is spaced apart from the top neck opening 17 about 7½ inches from the periphery of the top neck opening 17. The third attachment region 24 is positioned between the first and second attachment regions 22,23 so that the third attachment region 24 is spaced apart from the first and second attachment regions 22,23 and is positioned towards the second attachment region 23. Ideally, the third attachment region 24 is spaced apart from the periphery of the top neck opening 17 about 14 inches and spaced apart about 5 inches below the second attachment region 23. In use, the first attachment region 22 is detachably attachable to both the second and third attachment regions 23,24 as illustrated in FIGS. 4 and 5. Attachment of the first attachment region 22 to either the second or third attachment region allows holding up of the bottom edge of the front of the gown sot that it is out of the way. This is especially convenient when providing catheter and colostomy care and urinating while standing.

The outer side 12 of the back 14 of the hospital gown 10 has fourth and fifth attachment region 25,26. The fourth and fifth attachment region 25,26 are positioned on the outer side 12 of the back 14 of the hospital gown 10 adjacent the bottom edge 18 of the hospital gown 10. The fourth attachment region 25 is located adjacent one of the longitudinal edges formed by the main slit 19 while the fifth attachment region 26 is located adjacent another of the elongate edges formed by the main slit 19. In use, the fourth and fifth attachment region 25,26 each are detachably attachable to both the second and third attachment regions 23,24.

Preferably, fasteners permit detachable attachment of the first, fourth, and fifth attachment regions 22,25,26 to the second and third attachment regions 23,24. Ideally, the fasteners comprise detachable complementary portions of hooks and loops fasteners such as the type sold under the trade name Velcro. The first, fourth, and fifth attachment regions 22,25,26 each have a tab with a portion of a hooks and loops fastener (preferably the hooks portion of a hooks and loops fastener) provided thereon while the second and third attachment regions 23,24 each have a complementary portion of a hooks and loops fastener (preferably the loops portion of the hooks and loops fasteners) provided thereon which are detachably attachable to the portions of the hooks and loops fastener provided on the first, fourth, and fifth attachment regions 22,25,26.

Figure 2:
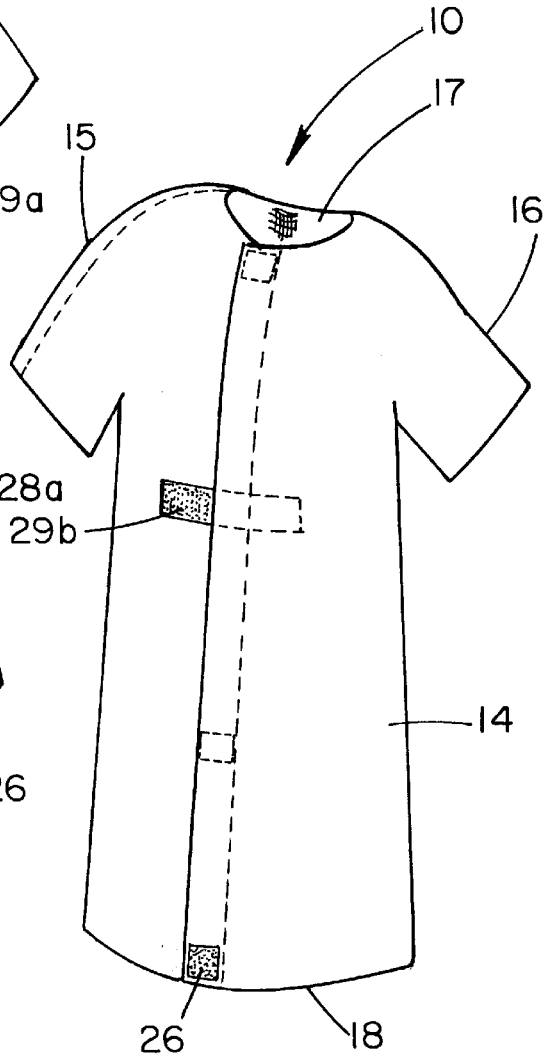
FIG. 2 is another schematic perspective view of the back of the present invention.
Figure 3:
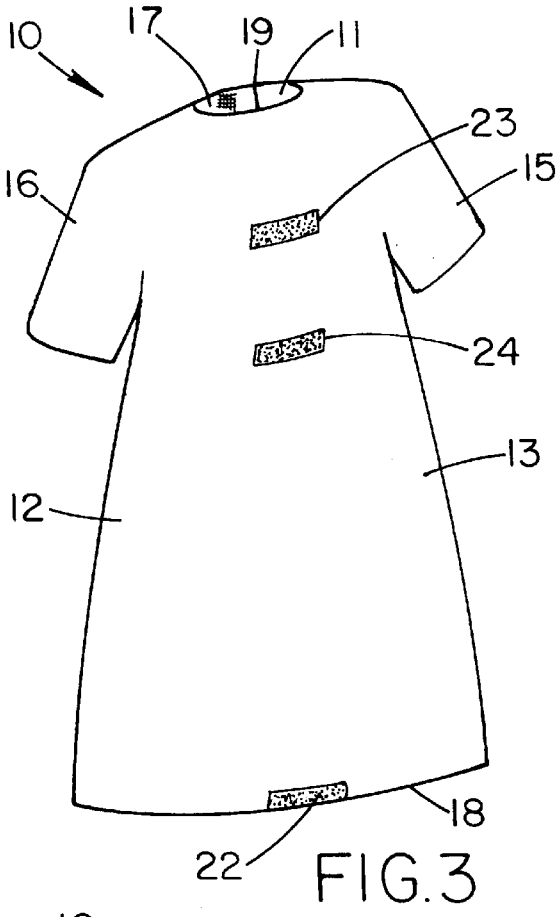
FIG. 3 is a schematic perspective view of the front of the present invention.

With reference to FIGS. 1 and 2, the inner side 11 of the hospital gown 10 adjacent one of the longitudinal edges formed by the main slit 19 is detachably attachable to the outer side 12 of the hospital gown 10 adjacent another of the longitudinal edges formed by the main slit 19 such that the longitudinal edges of the main slit 19 are coupled together to close the back of the gown. Preferably, the hospital gown 10 has a plurality of spaced apart main slit fasteners 27,28,29 detachably coupling the inner side 11 of the hospital gown 10 adjacent one of the longitudinal edges formed by the main slit 19 to the outer side 12 of the hospital gown 10 adjacent another of the longitudinal edges formed by the main slit 19. In the preferred embodiment, an upper main slit fastener 27*a*,27*b* is positioned adjacent the periphery of the top neck opening 17. A lower main slit fastener 28*a*,28*b* is positioned towards and spaced apart from the bottom edge 18 of the hospital gown 10. A middle main slit fastener 29*a*,29*b* is positioned between the upper and lower main slit fasteners 27,28. Ideally, the lower main slit fastener is positioned about 15 inches above the bottom edge 18 of the hospital gown 10. In this ideal embodiment, the middle main slit fastener is positioned about 29 inches above the bottom edge 18 of the gown 10. Ideally, the main slit fasteners 27,28,29 comprise hooks and loops fasteners each having a pair of complementary portions with one of the portions 27*b*,28*b*,29*b* of each of the hooks and loops fastener of the main slit fasteners provided on the inner side 11 of the back 14 of the hospital gown 10 adjacent the one of the longitudinal edges and another complementary portion 27*a*,28*a*, 29*a* of each of the hooks and loops fasteners of the main slit fasteners provided on the outer side 12 of the back 14 of the hospital gown 10 adjacent the another of the longitudinal edges. In this ideal embodiment, preferably, each of the hooks and loops fasteners of the main slit fasteners comprise a pair of rectangular tabs with the tabs of the upper and lower main slit fasteners ideally being about 2 inches by about 1½ inches and the tabs of the middle slit fastener 29*a*,29*b* being elongate rectangles with lengths extending along the width of the hospital gown 10. Ideally, the length of the tabs of the middle main slit fastener 29*a*,29*b* are about 11 inches and the width the tabs of the middle main slit fastener 29*a*,29*b* are about 1½ inches.

Each of the sleeves 15,16 of the hospital gown 10 has an arm opening 20. One of the sleeves 15 of the hospital gown 10 has an elongate shoulder slit 21 therethrough between the inner and outer sides 11,12 of the hospital gown 10. The shoulder slit 21 has a length extending between the top neck opening 17 and the arm opening 20 of the sleeves 15. The shoulder slit 21 forms a pair of lateral edges on the sleeves 15. The lateral edges formed by the shoulder slit 21 are detachably attachable to each other. Preferably, a hooks and loops fastener 30 detachably attaches the lateral edges together. The hooks and loops fastener has a pair of elongate strips 30*a*,30*b* each having a complementary portion of the hooks and loops fastener on them, one of the strips 30*b* (preferably the loops portion of the hooks and loops fastener) is provided on the inner side 11 of the hospital gown 10 and the other of the strips 30*a* (preferably the hooks portion of the hooks and loops fastener)is provided on the outer side 1t of the hospital gown 10. In an ideal illustrative embodiment, the strips are each about 12 inches by about ¾ inches. In use, the shoulder slit allows easier putting on and taking off of the gown from a user by eliminating the need for a user to insert both arms through the sleeves of the gown. This is very helpful for patients with limited mobility.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A garment, comprising:

a hospital gown having inner and outer sides, a front, a back, a pair of sleeves, a top neck opening, and a bottom edge;

said hospital gown having an elongate main slit therethrough between said inner and outer sides of said hospital gown, said main slit having a length extending between said top neck opening and said bottom edge of said hospital gown, said main slit being located on said back of said hospital gown;

said outer side of said front of said hospital gown having spaced apart first, second and third attachment regions;

said first attachment region being positioned adjacent said bottom edge of said hospital gown;

said second attachment region being positioned between said top neck opening and said first attachment region, said second attachment region being spaced apart from said top neck opening;

said third attachment region being positioned between said first and second attachment regions, said third attachment region being spaced apart from said first and second attachment regions and being positioned towards said second attachment region;

said first attachment region being detachably attachable to said second and third attachment regions;

said outer side of said back of said hospital gown having fourth and fifth attachment regions, said fourth and fifth attachment regions being positioned on said outer side of said back of said hospital gown adjacent said bottom edge of said hospital gown; and said fourth and fifth attachment regions each being detachably attachable to said second and third attachment regions.

2. The garment of claim 1, wherein said main slit forming a pair longitudinal edges on said back of said hospital gown, wherein said fourth attachment region is located adjacent one of said longitudinal edges formed by said main slit, and wherein said fifth attachment region is located adjacent another of said elongate edges formed by said main slit.

3. The garment of claim 1, wherein each of said sleeves of said hospital gown has an arm opening, one of said sleeves of said hospital gown having an elongate shoulder slit therethrough between said inner and outer sides of said hospital gown, said shoulder slit having a length extending between said top neck opening and said arm opening of said one of said sleeves, said shoulder slit forming a pair of lateral edges on said one of said sleeves, said lateral edges formed by said shoulder slit being detachably attachable to each other.

4. The garment of claim 3, wherein a hooks and loops fastener detachably attaches said lateral edges together.

5. The garment of claim 1, wherein fasteners permit detachable attachment of said first, fourth, and fifth attachment regions to said second and third attachment regions.

6. The garment of claim 5, wherein said fasteners comprise complementary portions of hooks and loops fasteners, said first, fourth, and fifth attachment regions each having a portion of a hooks and loops fastener provided thereon, said second and third attachment regions each having a complementary portion of a hooks and loops fastener provided thereon detachably attachable to said portions of the hooks and loops fastener provided on said first, fourth, fifth attachment regions.

7. The garment of claim 1, wherein said inner side of said hospital gown adjacent one of a pair of longitudinal edges formed by said main slit is detachably attachable to said outer side of said hospital gown adjacent another of said longitudinal edges formed by said main slit such that said longitudinal edges of said main slit are coupled together.

8. The garment of claim 7, wherein said hospital gown has a plurality of spaced apart main slit fasteners detachably coupling said inner side of said hospital gown adjacent one of said longitudinal edges formed by said main slit to said outer side of said hospital gown adjacent another of said longitudinal edges formed by said main slit.

9. The garment of claim 8, wherein an upper main slit fastener of said plurality of main slit fasteners is positioned adjacent said top neck opening, wherein a lower main slit fastener of said plurality of main slit fasteners is positioned towards and spaced apart from said bottom edge of said hospital gown, wherein a middle main slit fastener of said plurality of main slit fasteners is positioned between said upper and lower main slit fasteners.

10. The garment of claim 9, wherein said main slit fasteners comprise hooks and loops fasteners each having a pair of complementary portions, one of said portions of each of said hooks and loops fastener of said main slit fasteners being provided on said inner side of said back of said hospital gown adjacent said one of said longitudinal edges, another complementary portion of each of said hooks and loops fasteners of said main slit fasteners being provided on said outer side of said back of said hospital gown adjacent said another of said longitudinal edges.

11. A garment, comprising:

a hospital gown having inner and outer sides, a front, a back, a pair of sleeves, a top neck opening, and a bottom edge;

said hospital gown having a width and a length;

said hospital gown having an elongate main slit therethrough between said inner and outer sides of said hospital gown, said main slit having a length extending between said top neck opening and said bottom edge of said hospital gown, said main slit being located on said back of said hospital gown;

said main slit forming a pair longitudinal edges on said back of said hospital gown;

each of said sleeves of said hospital gown having an arm opening;

one of said sleeves of said hospital gown having an elongate shoulder slit therethrough between said inner and outer sides of said hospital gown, said shoulder slit having a length extending between said top neck opening and said arm opening of said one of said sleeves;

said shoulder slit forming a pair of lateral edges on said one of said sleeves;

said outer side of said front of said hospital gown having spaced apart first, second and third attachment regions;

said first, second, and third attachment regions being located on said outer side of said front of said hospital gown along a line extending between top neck opening and said bottom edge at a mid point of said width of said hospital gown;

said first attachment region being positioned adjacent said bottom edge of said hospital gown;

said second attachment region being positioned between said top neck opening and said first attachment region, said second attachment region being spaced apart from said top neck opening;

said third attachment region being positioned between said first and second attachment regions, said third attachment region being spaced apart from said first and second attachment regions and being positioned towards said second attachment region;

said first attachment region being detachably attachable to said second and third attachment regions;

said outer side of said back of said hospital gown having fourth and fifth attachment regions, said fourth and fifth attachment regions being positioned on said outer side of said back of said hospital gown adjacent said bottom edge of said hospital gown, said fourth attachment region being located adjacent one of said longitudinal edges formed by said main slit, said fifth attachment region being located adjacent another of said elongate edges formed by said main slit;

said fourth and fifth attachment regions each being detachably attachable to said second and third attachment regions;

wherein fasteners permit detachable attachment of said first, fourth, and fifth attachment regions to said second and third attachment regions, wherein said fasteners comprises complementary portions of hooks and loops fasteners, said first, fourth, and fifth attachment regions each having a portion of a hooks and loops fastener provided thereon, said second and third attachment regions each having a complementary portion of a hooks and loops fastener, provided thereon detachably attachable to said portions of the hooks and loops fastener provided on said first, fourth, fifth attachment regions;

said inner side of said hospital gown adjacent one of said longitudinal edges formed by said main slit being detachably attachable to said outer side of said hospital gown adjacent another of said longitudinal edges formed by said main slit such that said longitudinal edges of said main slit are coupled together;

wherein said hospital gown has a plurality of spaced apart main slit fasteners detachably coupling said inner side of said hospital gown adjacent one of said longitudinal edges formed by said main slit to said outer side of said hospital gown adjacent another of said longitudinal edges formed by said main slit;

wherein an upper main slit fastener of said plurality of main slit fasteners is positioned adjacent said top neck opening, wherein a lower main slit fastener of said plurality of main slit fasteners is positioned towards and spaced apart from said bottom edge of said hospital gown, wherein a middle main slit fastener of said plurality of main slit fasteners is positioned between said upper and lower main slit fasteners;

wherein said main slit fasteners comprise hooks and loops fasteners each having a pair of complementary portions, one of said portions of each of said hooks and loops fastener of said main slit fasteners being provided on said inner side of said back of said hospital gown adjacent said one of said longitudinal edges, another complementary portion of each of said hooks and loops fasteners of said main slit fasteners being provided on said outer side of said back of said hospital gown adjacent said another of said longitudinal edges; and said lateral edges formed by said shoulder slit being detachably attachable to each other, wherein a hooks and loops fastener detachably attaches said lateral edges together.

* * * * *